US009627153B2

(12) United States Patent
Pisu et al.

(10) Patent No.: US 9,627,153 B2
(45) Date of Patent: Apr. 18, 2017

(54) ELECTRICAL MEDIUM OR HIGH VOLTAGE SWITCHING DEVICE

(71) Applicant: ABB Schweiz AG, Baden (CH)

(72) Inventors: Francesco Pisu, Birmenstorf (CH); Helmut Heiermeier, Wutoeschingen (DE); Jadran Kostovic, Wettingen (CH); Jakub Korbel, Baden (CH); Luca Lienhard, Ottenbach (CH); Reto Karrer, Stafa (CH); Timothy Sutherland, Zweidlen (CH)

(73) Assignee: ABB Schweiz AG, Baden (CH)

( * ) Notice: Subject to any disclaimer, the term of this patent is extended or adjusted under 35 U.S.C. 154(b) by 44 days.

(21) Appl. No.: 14/079,068

(22) Filed: Nov. 13, 2013

(65) Prior Publication Data

US 2014/0131183 A1 May 15, 2014

(30) Foreign Application Priority Data

Nov. 13, 2012 (EP) ..... 12192466

(51) Int. Cl.
*H01H 1/00* (2006.01)
*H01H 9/00* (2006.01)
*H01H 1/38* (2006.01)

(52) U.S. Cl.
CPC ..... *H01H 1/00* (2013.01); *H01H 1/385* (2013.01)

(58) Field of Classification Search
CPC .. H01H 9/00; H01H 1/00; H01H 1/12; H01H 1/14; H01H 1/2041; H01H 1/38; H01H 1/46; H01H 3/00; H01H 3/02; H01H 69/00; H01H 71/00; H01H 71/46; H01H 71/50; H01H 71/52; H01H 2203/00;
(Continued)

(56) References Cited

U.S. PATENT DOCUMENTS 1,978,246 A * 10/1934 Bauerschmidt ..... H01H 1/42 200/255
3,427,419 A * 2/1969 Findley, Jr. ..... H01H 1/42 200/255

(Continued)

FOREIGN PATENT DOCUMENTS

DE 4212740 A1 10/1993
DE 102004061276 A1 6/2006
EP 0844631 A2 5/1998

OTHER PUBLICATIONS

European Search Report Application No. EP 12 19 2466 Completed: Apr. 18, 2013; Mailing Date: Apr. 25, 2013 4 pages.

*Primary Examiner* — Anthony R. Jimenez
(74) *Attorney, Agent, or Firm* — Whitmyer IP Group LLC

(57) ABSTRACT

An electrical switching device for medium or high voltage circuits having at least a nominal contact arrangement, wherein the nominal contact arrangement includes at least a first nominal contact including a plurality of contact fingers forming a finger cage concentric with respect to a longitudinal axis, wherein the contact fingers are separated from one another by empty slots extending up to a free end of the contact fingers. The empty slots include first and second empty slots, wherein the second empty slots are shorter than the first empty slots, and wherein the contact fingers are grouped in groups, with the contact fingers of each group being separated by second empty slots and the contact fingers of adjacent groups being separated by first empty slots.

13 Claims, 4 Drawing Sheets

(58) Field of Classification Search
CPC ..... H01H 2203/02; H01H 2203/034; H01H 2203/042; H01H 2203/05
See application file for complete search history.

(56) References Cited

U.S. PATENT DOCUMENTS

| | | | | | |
|---|---|---|---|---|---|
| 4,012,608 | A | * | 3/1977 | Lockard | 200/16 D |
| 4,319,105 | A | * | 3/1982 | Lott | H01H 33/128 200/271 |
| 4,553,008 | A | * | 11/1985 | Veverka et al. | 218/56 |
| 5,820,413 | A | * | 10/1998 | Yamada | H01H 85/201 439/620.26 |
| 5,981,893 | A | * | 11/1999 | Bleiker et al. | 218/48 |
| 2004/0216988 | A1 | * | 11/2004 | Receveur et al. | 200/181 |

* cited by examiner

ELECTRICAL MEDIUM OR HIGH VOLTAGE SWITCHING DEVICE

FIELD OF THE INVENTION

The invention relates to the field of medium and high voltage switching technologies and concerns an electrical switching device according to the independent claim, particularly for a use as an earthing device, a fast-acting earthing device, a circuit breaker or a disconnector switch in power distribution systems.

BACKGROUND OF THE INVENTION

Electrical switching devices are well known in the field of high voltage switching applications. They are e.g. used for interrupting a current when an electrical fault occurs. As an example for an electrical switching device, circuit breakers have the task of opening contacts and keeping them far apart from one another in order to avoid a current flow, even in case of high electrical potential originating from the electrical fault itself. For the purposes of this document the term high voltage refers to voltages higher than 72.5 kV and the term medium voltage refers to voltages between 1 kV and 72.5 kV. The electrical switching devices, like the circuit breakers, may have to be able to carry high nominal currents of 5000 A to 6300 A and to switch very high short circuit currents of 63 kA to 80 kA at very high voltages of 550 kV to 1200 kV.

Because of the high nominal current, the electrical switching devices of today require many so-called contact fingers for the nominal current. When disconnecting a nominal current within the electrical switching devices, the current commutates from the nominal contacts of the electrical switching device to its arcing contacts.

SUMMARY OF THE INVENTION

It is an objective of the present invention to enhance an electrical switching device in terms of robustness by preventing damage to its contact fingers.

This objective is solved by an electrical switching device for medium or high voltage circuits having at least a nominal contact arrangement is provided. Its nominal contact arrangement comprises at least a first nominal contact comprising a plurality of contact fingers forming a finger cage. The finger cage is concentric with respect to a longitudinal axis. The contact fingers are separated from one another by empty slots extending up to a free end of the contact fingers. The nominal contact arrangement further comprises at least a mating second nominal contact. At least one of the nominal contacts is movable parallel to the longitudinal axis and cooperates with the other nominal contact for closing and opening the electric switching device.

In an ideal case all contact fingers of a known electrical switching device, e.g. a circuit breaker, would be separated from the mating nominal contact simultaneously. In practical embodiments of known circuit breakers or switches some of the contact fingers separate later than the rest of the contact fingers. Thus, before commuting to the arcing contact, the current still flows through the contact fingers that are still in contact with the mating nominal contact, for a period of time. It is only when these contact fingers have also lost contact with the mating nominal contact that the current switches to the arcing contacts. During the period when the entire current flows through the contact fingers which have separated later, significant electromagnetic forces act on these contact fingers and can deform them permanently. The deformation manifests itself in that adjacent fingers are attracted towards one another as a result of the Lorentz-force and may therefore be bent in a non-radial direction with respect to the longitudinal axis.

Thus, in order to minimize the risk of damage, according to the invention the empty slots comprise first and second empty slots. The second empty slots are shorter than the first empty slots. Furthermore, the contact fingers are grouped in groups, with the fingers of each group being separated by second empty slots and the fingers of adjacent groups being separated by first empty slots.

By grouping the contact fingers, the overall circumferential stiffness is increased, with the result that the bending of the contact fingers is avoided or at least reduced or minimized. It is noted here that the empty slots are necessary in order to decrease the radial stiffness of the first nominal contact and provide a certain elasticity such that the second nominal contact can mechanically contact the first nominal contact by force fit, that is, the second tube-shaped nominal contact is inserted into the finger cage by displacing the contact fingers radially outwards with respect to the longitudinal axis when the electrical switching device is closed. The required elasticity of the contact fingers is also advantageous in order to compensate for manufacturing tolerances of the nominal contacts.

In an embodiment each group of contact fingers comprises at least two contact fingers. In another embodiment each group of contact fingers comprises at least three contact fingers.

The higher the number of contact fingers is, the higher electromagnetic forces the contact fingers can withstand. Thus, the electrical switching device can be designed in a flexible way by choosing a number of contact fingers per group such that they can withstand the specific currents flowing through them in that particular electrical switching device.

In yet another embodiment the groups each have the same number of contact fingers. This advantageously ensures that the stiffness of the finger cage is evenly distributed for all contact fingers.

BRIEF DESCRIPTION OF THE DRAWINGS

Further embodiments, advantages and applications of the invention result from the dependent claims and from the following description of the figures.

DETAILED DESCRIPTION OF THE INVENTION

The invention is described for the example of a high voltage circuit breaker, but the principles described in the following also apply for the usage of the invention in other switching devices, e.g. of the type mentioned in the "Background"-section, such as in an earthing switch, fast-acting earthing switch, disconnector, combined disconnector and earthing switch, load break switch, generator circuit breaker, and generally in any switch. The most preferred use is in switches for high voltage and medium voltage.

Figure 1:
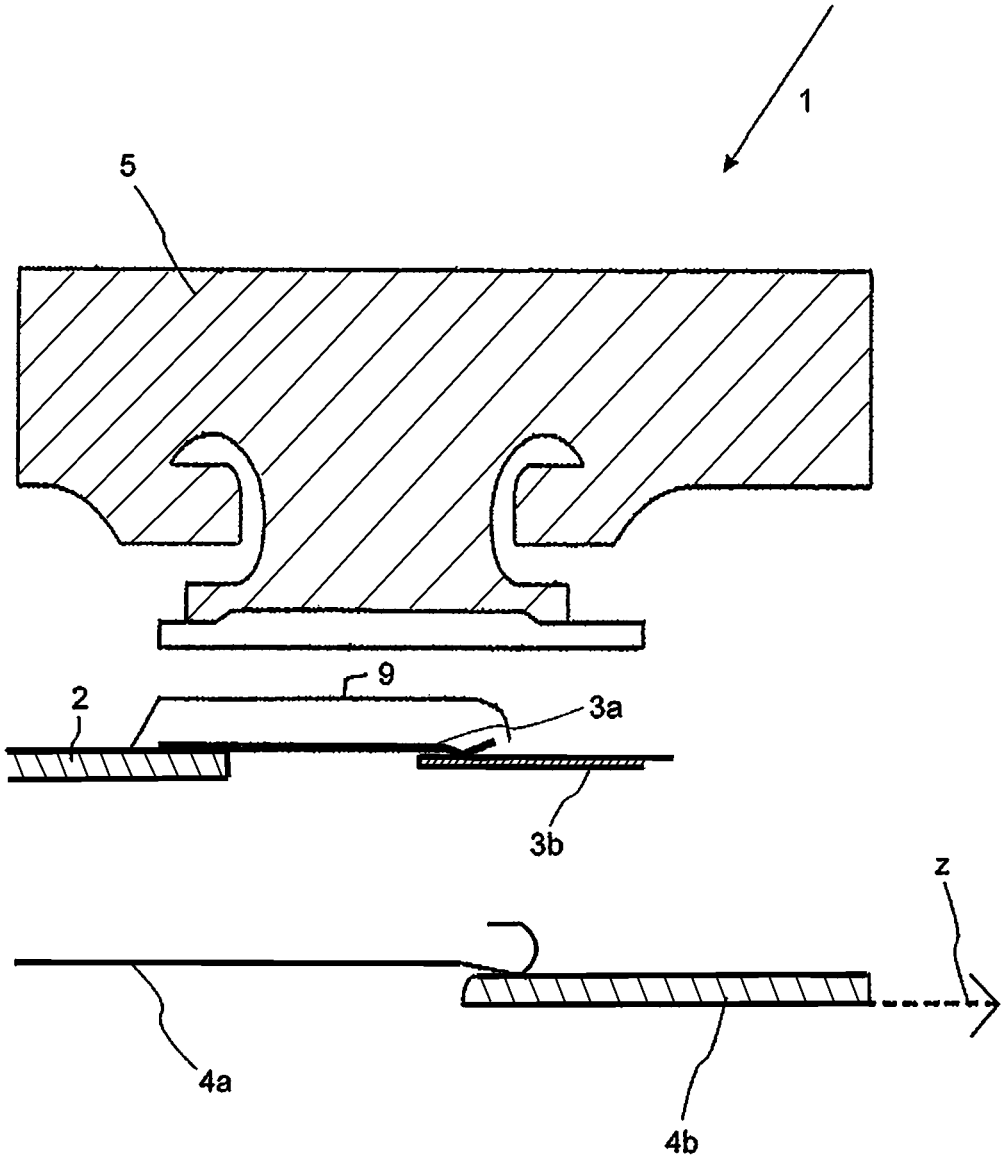
FIG. 1 shows a partial sectional view of a simplified basic embodiment of a high voltage circuit breaker.

FIG. 1 shows a partial sectional view of a simplified basic embodiment of a high voltage circuit breaker 1 in a closed configuration. In FIG. 1 "partial sectional view" means that only a part of the upper half of the circuit breaker is shown, for reasons of clarity. The device is rotationally symmetric about a longitudinal axis z. Only the elements of the circuit breaker 1 which are related to the present invention are described in the following, other elements present in the figures are not relevant for understanding the invention and are known by the skilled person in high voltage electrical engineering.

A "closed configuration" as used herein means that nominal contacts of the circuit breaker are closed and are thus conducting a nominal current.

The circuit breaker 1 comprises a chamber enclosed by a shell or enclosure 5 which normally is cylindrical around the longitudinal axis z. It further comprises a nominal contact arrangement formed by a first nominal contact comprising a plurality of contact fingers 3*a*, of which only one is shown here for reasons of clarity. The nominal contact arrangement is formed as a finger cage around the longitudinal axis z. The term "finger cage" as used herein refers to an arrangement, for example a cylindrical or conical or oval arrangement, of the contact fingers around the longitudinal axis z. A shielding 9 can be arranged around the finger cage. The nominal contact arrangement further comprises a second mating contact 3*b* which normally is a metal tube. The contact fingers 3*a* and the second contact 3*b* are movable relatively to one other from the closed configuration shown in FIG. 1, in which they are in electrical contact to one another, into an opened configuration, in which they are apart from one another, and vice versa. It is also possible that only one of the contacts 3*a*, 3*b* moves parallel to the longitudinal axis z and the other contact 3*b*, 3*a* is stationary with respect to the longitudinal direction z.

The contact fingers 3*a* are attached to or can be a part of a finger support 2, particularly a metal support cylinder 2.

The circuit breaker 1 furthermore comprises an arcing contact arrangement formed by a first arcing contact 4*a* and a second arcing contact 4*b*.

The first nominal contact and the first arcing contact 4*a* are typically not movable relatively to one another. In the same way, the second nominal contact 3*b* and the second arcing contact 4*b* are not movable with respect to one another. For the explanatory purposes of the present invention it is assumed that only the second nominal contact 3*b* and the arcing contact 4*b* are movable and the finger cage is stationary along the z-axis.

When the closed circuit of FIG. 1 shall be disconnected, the second nominal contact 3*b* and the second arcing contact 4*b* are moved parallel to the direction of the z-axis into the direction indicated by the z-arrow, such that the nominal contact arrangement disconnects first. Thereafter, the current commutates to the arcing contact arrangement, which is still closed. With further movement of the second nominal contact 3*b* and the second arcing contact 4*b* into the direction of the z-arrow, the arcing contact arrangement also disconnects, thereby creating an electric arc between the arcing contacts 4*a*, 4*b*, which is normally blasted out in a very short time. These principles are known and are therefore not explained in more detail here.

Figure 2:
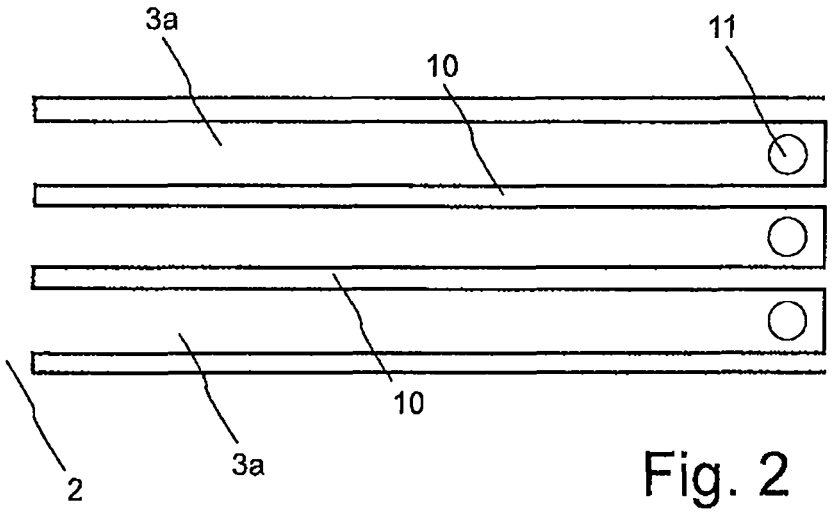
FIG. 2 shows a detailed view, in radial direction, of three contact fingers of a finger cage of the high voltage circuit breaker of FIG. 1 according to the prior art.

FIG. 2 shows a detailed view of three contact fingers 3*a* of a finger cage of the high voltage circuit breaker 1 of FIG. 1 according to the prior art. This view shows the contact fingers 3*a* as they are seen "from within" the finger cage. This also applies for FIG. 3. The contact fingers 3*a* are attached to or can be a part of the finger support 2 of FIG. 1. The contact fingers 3*a* are separated by empty slots 10, the purpose of which has been mentioned above. Furthermore, the contact areas 11 for the second nominal contact 4*b* (not shown) are denoted by the circles 11. Thus, the second nominal contact 3*b* contacts the contact fingers 3*a* in the area 11 of their free end.

Figure 3:
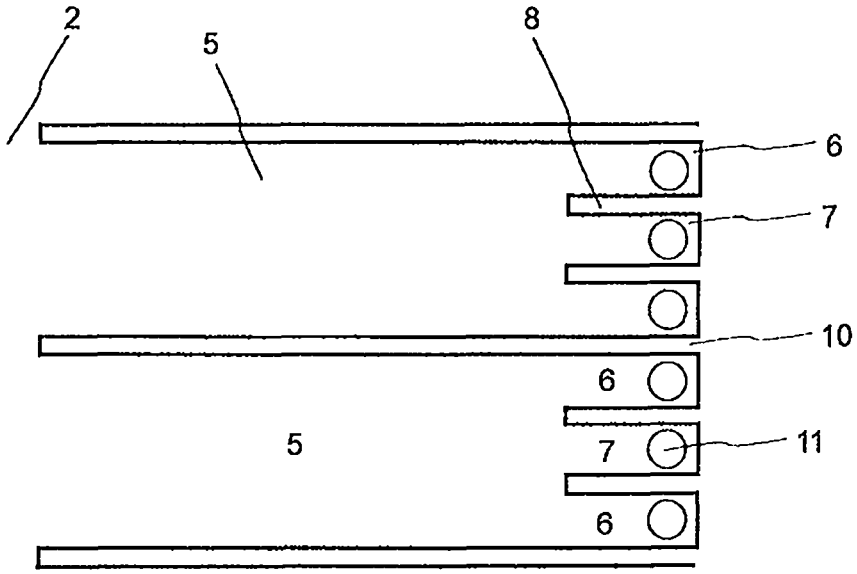
FIG. 3 shows a detailed view, in radial direction, of two groups of contact fingers of the finger cage of the high voltage circuit breaker of FIG. 1 according to one embodiment of the invention.

FIG. 3 shows a detailed view of two groups 5 of contact fingers 6, 7 of the finger cage of the high voltage circuit breaker of FIG. 1 according to the invention. In this configuration there are three contact fingers 6, 7 per one group 5 of contact fingers 6, 7. However, as mentioned above, the groups can comprise only two contact fingers 6, 7 or more than three contact fingers 6, 7, depending on the configuration of the circuit breaker 1. As can be seen, the groups of contact fingers 6, 7 are separated from each other by first empty slots 10, which are basically similar to those of the prior art configuration of FIG. 2. The contact fingers 6, 7 of one group 5 are separated from each other by second empty slots 8 which are shorter than the first empty slots 10.

In embodiments, each contact finger 6, 7 is adjacent to at least one second empty slot 8. Thus, there are no contact fingers which are adjacent to only first slots 10, which would again decrease their stiffness.

In embodiments, the total number of the contact fingers 6, 7 is not a prime number. By this, it is ensured that all contact fingers 6, 7 can be grouped in suitable groups which all comprise the same number of fingers without occurrence of ungrouped contact fingers 6, 7. Of course, for this purpose the total number of contact fingers 6, 7 has to be a multiple of the number of contact fingers 6, 7 in one group 5.

Figure 4:
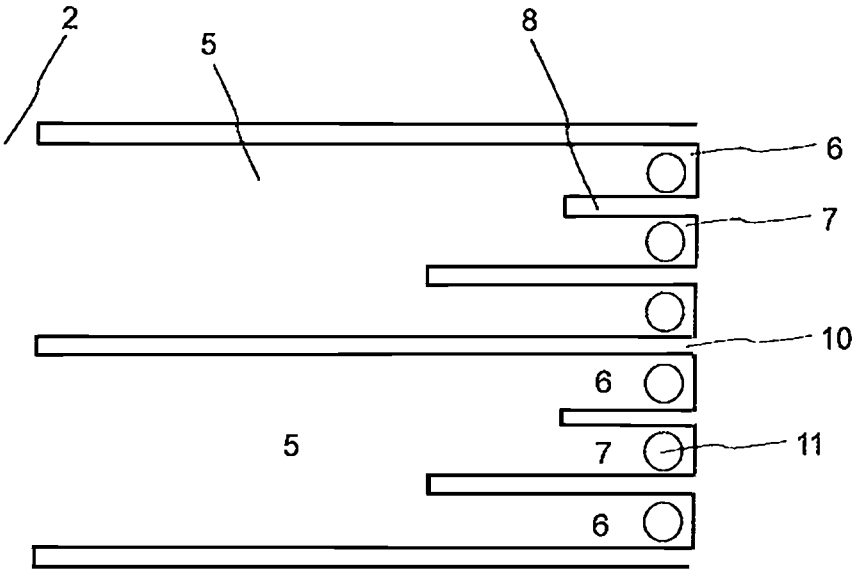
FIG. 4 shows a detailed view, in radial direction, of two groups of contact fingers of the finger cage of the high voltage circuit breaker of FIG. 1 according to another embodiment of the invention.

In one embodiment of the invention all the second empty slots 8 have the same length (FIG. 3), whereas in another embodiment of the invention the second empty slots 8 have different lengths (FIG. 4). In the latter case, a largest length of the second empty slots 8 may advantageously exceed a smallest length of the second empty slots 8 by at least 20%, as shown in FIG. 4. These options make the finger cage more flexible in terms of construction.

In embodiments, the second empty slots 8 are shorter than the first empty slots 10 by at least 50%. This ensures that both criteria, a good radial flexibility and a good circumferential stiffness, are met.

The contact fingers 6, 7 are elastically deformed in a radial direction upon closing the electrical switching device, here the circuit breaker 1.

Figure 5:
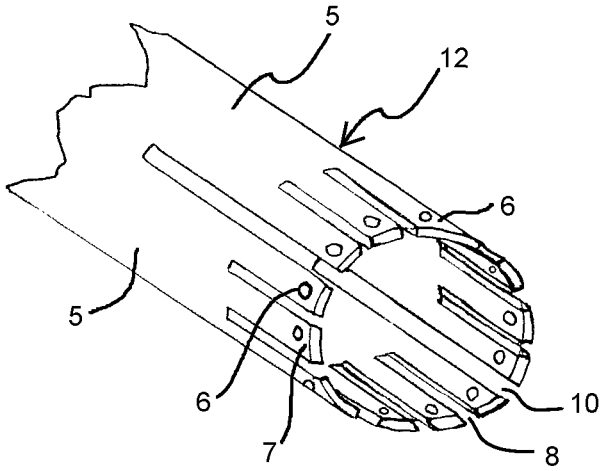
FIG. 5 shows a perspective view of contact fingers of the finger cage of the high voltage circuit breaker of FIG. 1 according to one embodiment of the invention.

As mentioned, the contact fingers 6, 7 form the finger cage. Particularly, the contact fingers 6, 7 are formed by a tubular metal section 12. The first and second empty slots 10, 8 extend from a first end into the tubular metal section and the contact fingers 6, 7 are interconnected at a second end of the tubular metal section, as shown in FIGS. 3-5.

While there are shown and described presently preferred embodiments of the invention, it is to be distinctly understood that the invention is not limited thereto but may otherwise variously be embodied and practised within the scope of the following claims. Therefore, terms like "preferred" or "in particular" or "particularly" or "advantageously" signify optional and exemplary embodiments only.

What is claimed is:

1. An electrical switching device for medium or high voltage circuits comprising:

a chamber enclosed by an enclosure which is cylindrical around a longitudinal axis, at least one nominal contact arrangement, wherein the nominal contact arrangement comprises:

at least one first nominal contact comprising a plurality of contact fingers forming a finger cage concentric with respect to the longitudinal axis, wherein the contact fingers are separated from one another by empty slots extending up to a free end of the contact fingers, and at least one mating second nominal contact, the at least one second nominal contact is tube-shaped, wherein at least one of the nominal contacts is movable parallel to the longitudinal axis and cooperates with the other nominal contact for closing and opening the electric switching device, the empty slots having first and second empty slots, wherein the second empty slots are shorter than the first empty slots, and wherein the contact fingers are grouped in groups, with the contact fingers of each group being separated by the second empty slots and the contact fingers of adjacent groups being separated by the first empty slots;

wherein each group comprises at least two contact fingers, and wherein the contact fingers are formed by a tubular metal section, wherein the first empty slots and the second empty slots extend from a first end into the tubular metal section, and wherein the contact fingers are interconnected at a second end of the tubular metal section.

2. The electrical switching device according to claim 1, wherein each contact finger is adjacent to at least one of the second empty slots.

3. The electrical switching device according to claim 1, wherein the groups each have the same number of contact fingers.

4. The electrical switching device according to claim 1, wherein a total number of the contact fingers is not a prime number.

5. The electrical switching device according to claim 1, wherein all of the second empty slots have the same length.

6. The electrical switching device according to claim 1, wherein the second empty slots are shorter than the first empty slots by at least 50%.

7. The electrical switching device according to claim 1, wherein the contact fingers are elastically deformed in a radial direction upon closing the electrical switching device.

8. The electrical switching device according to claim 1, being an earthing switch, a fast-acting earthing switch, a disconnector, a combined disconnector and earthing switch, a load break switch, a circuit breaker, or a generator circuit breaker.

9. The electrical switching device according to claim 1, wherein each group comprises at least three contact fingers.

10. The electrical switching device according to claim 1, wherein each contact finger extends linearly.

11. The electrical switching device according to claim 1, wherein the second empty slots have different lengths.

12. The electrical switching device according to claim 11, wherein a largest length of the second empty slots exceeds a smallest length of the second empty slots by at least 20%.

13. An electrical switching device for medium or high voltage circuits comprising:

a chamber enclosed by an enclosure which is cylindrical around a longitudinal axis, at least one nominal contact arrangement, wherein the nominal contact arrangement comprises:

at least one first nominal contact comprising a plurality of contact fingers forming a finger cage concentric with respect to the longitudinal axis, wherein the contact fingers are separated from one another by empty slots extending up to a free end of the contact fingers, and at least one mating second nominal contact, wherein at least one of the nominal contacts is movable parallel to the longitudinal axis and cooperates with the other nominal contact for closing and opening the electric switching device, the empty slots having first and second empty slots, wherein the second empty slots are shorter than the first empty slots, wherein the contact fingers are grouped in groups, the contact fingers within the same group being separated by the second empty slots, and wherein the contact fingers that are from different groups and that are adjacent to one another are separated by the first empty slots;

wherein each group comprises at least two contact fingers;

wherein the contact fingers are formed by a tubular metal section, wherein the first empty slots and the second empty slots extend from a first end into the tubular metal section, and wherein the contact fingers are interconnected at a second end of the tubular metal section.

* * * * *